US007806479B2

(12) United States Patent
Jensen et al.

(10) Patent No.: US 7,806,479 B2
(45) Date of Patent: Oct. 5, 2010

(54) SEAT WITH ADJUSTABLE DYNAMIC JOINT

(75) Inventors: Hans R. Jensen, Platteville, WI (US); Robert J. Jensen, Stewartville, MN (US)

(73) Assignee: Wisys Technology Foundation, Madison, WI (US)

( * ) Notice: Subject to any disclaimer, the term of this patent is extended or adjusted under 35 U.S.C. 154(b) by 57 days.

(21) Appl. No.: 12/031,241

(22) Filed: Feb. 14, 2008

(65) Prior Publication Data

US 2008/0191525 A1 Aug. 14, 2008

Related U.S. Application Data

(60) Provisional application No. 60/889,844, filed on Feb. 14, 2007.

(51) Int. Cl.
*A47C 1/024* (2006.01)

(52) U.S. Cl. ..... 297/303.1; 297/325; 297/344.14; 297/258.1; 248/158

(58) Field of Classification Search ..... 297/258.1, 297/260.1, 313, 343.24, 344.24, 303.1, 325, 297/344.14, 344.16, 302.7; 482/1; 248/371, 248/372.1, 398, 158
See application file for complete search history.

(56) References Cited

U.S. PATENT DOCUMENTS

| | | | | | |
|---|---|---|---|---|---|
| 968,195 | A | | 8/1910 | Reed | |
| 2,184,988 | A | * | 12/1939 | Collier et al. | 248/575 |
| 3,368,806 | A | * | 2/1968 | Szonn | 267/153 |
| 3,813,069 | A | | 5/1974 | Fletcher | |
| 3,863,982 | A | | 2/1975 | Sandham | |
| 4,027,843 | A | | 6/1977 | Thompson | |
| 4,099,697 | A | | 7/1978 | Von Schuckmann | |
| 4,185,803 | A | | 1/1980 | Kalvatn | |
| 4,254,990 | A | | 3/1981 | Kelley | |
| 4,425,863 | A | | 1/1984 | Cutler | |
| 4,431,157 | A | | 2/1984 | Arild | |
| 4,498,656 | A | | 2/1985 | Arild | |
| 4,575,151 | A | | 3/1986 | Edstrom | |
| 4,598,946 | A | * | 7/1986 | Cone | 297/258.1 |
| 4,605,334 | A | | 8/1986 | Kalvatn | |
| 4,807,841 | A | | 2/1989 | Edstrom | |
| 4,830,345 | A | | 5/1989 | Mar | |
| 4,871,208 | A | | 10/1989 | Hodgdon | |
| 4,974,904 | A | * | 12/1990 | Phillips et al. | 297/258.1 |
| 5,044,587 | A | * | 9/1991 | Degen | 248/158 |
| 5,297,539 | A | | 3/1994 | Liebl et al. | |
| 5,362,302 | A | | 11/1994 | Jensen et al. | |
| 5,409,295 | A | | 4/1995 | Edstrom | |
| 5,515,078 | A | | 5/1996 | Greschler et al. | |
| 5,573,304 | A | | 11/1996 | Glockl | |
| 5,577,803 | A | | 11/1996 | Guilbaud | |
| 5,649,740 | A | | 7/1997 | Hodgdon | |

(Continued)

FOREIGN PATENT DOCUMENTS

| | | |
|---|---|---|
| EP | 1106111 | 6/2001 |

(Continued)

*Primary Examiner*—Laurie K Cranmer
(74) *Attorney, Agent, or Firm*—Boyle Fredrickson, S.C.

(57) ABSTRACT

A pivoting joint for use in a task chair or the like provides an adjustable elastomeric coupling that permits multi-axis rocking of the seat pan with a restoring force that provides controlled stability.

10 Claims, 5 Drawing Sheets

U.S. PATENT DOCUMENTS 5,728,049 A 3/1998 Alberts
5,746,481 A 5/1998 Obermaker
5,769,492 A 6/1998 Jensen
5,795,022 A 8/1998 Brown
5,901,612 A 5/1999 Letovsky
5,909,208 A 6/1999 Bloomdahl
5,909,925 A 6/1999 Glockl
5,976,097 A 11/1999 Jensen
6,003,944 A 12/1999 Glockl
6,019,422 A * 2/2000 Taormino et al. ..... 297/195.1
6,033,021 A 3/2000 Udo et al.
6,176,548 B1 1/2001 Thole et al.
6,209,958 B1 4/2001 Thole
6,398,303 B1 6/2002 Hermann et al.
6,481,795 B1 11/2002 Pettibon
6,595,586 B2 * 7/2003 Brightbill et al. ..... 297/312
6,644,742 B1 11/2003 Walser
6,685,268 B2 2/2004 Meyer
6,688,689 B1 2/2004 Thorn
6,709,052 B2 3/2004 Jalkanen
6,827,401 B2 * 12/2004 Marshall et al. ..... 297/302.1
6,863,017 B2 * 3/2005 Charles et al. ..... 114/363
6,866,340 B1 3/2005 Shaw
6,910,736 B2 6/2005 White
6,979,059 B1 * 12/2005 Conlin ..... 297/440.15
7,008,017 B1 3/2006 Wegener
7,008,359 B2 3/2006 Fan et al.
7,063,386 B2 6/2006 Dowty et al.
7,100,983 B1 9/2006 Gant
7,335,134 B1 * 2/2008 LaVelle ..... 482/1
7,396,080 B2 * 7/2008 Suhr et al. ..... 297/313
7,434,880 B2 * 10/2008 Ronnestad ..... 297/313
7,513,852 B2 * 4/2009 Wilkins et al. ..... 482/8
2002/0043846 A1 4/2002 Brauning
2003/0032533 A1 2/2003 Hecox et al.
2005/0173952 A1 8/2005 Van Der Laan
2006/0217233 A1 * 9/2006 Lee ..... 482/9
2006/0229159 A1 * 10/2006 Nagata et al. ..... 482/1
2006/0252608 A1 * 11/2006 Kang et al. ..... 482/84
2007/0184953 A1 * 8/2007 Luberski et al. ..... 482/146
2007/0219050 A1 * 9/2007 Merril ..... 482/1
2007/0232451 A1 * 10/2007 Hanoun ..... 482/1
2007/0241599 A1 * 10/2007 Hodgdon ..... 297/313
2007/0249466 A1 * 10/2007 Chiari et al. ..... 482/1

FOREIGN PATENT DOCUMENTS

WO WO 2005/018384 3/2005

* cited by examiner

SEAT WITH ADJUSTABLE DYNAMIC JOINT

CROSS-REFERENCE TO RELATED APPLICATIONS

This application claims the benefit of U.S. Provisional Application 60/889,844, filed Feb. 14, 2007, the disclosure of which is incorporated herein by reference.

STATEMENT REGARDING FEDERALLY SPONSORED RESEARCH OR DEVELOPMENT

BACKGROUND OF THE INVENTION

The present invention relates to chairs and other seating devices and in particular to a seat that promotes healthy active sitting.

Many people, particularly in industrialized countries, sit for much of the time that they are awake. Although inactive sitting requires less physical effort than standing or walking, it can put excessive stress on the lumbar area of the spine. Prolonged inactive sitting also decreases muscle tone in the back, fluid movement in and around the spine, and blood circulation. Research studies indicate that small movements throughout the day can benefit metabolism, circulation, digestion, and even healing.

One innovative seating alternative proposed to promote this desirable movement is a "seating ball", an inflated ball having a diameter approximating a standard height of a chair seat upon which the user sits. The seating ball is fundamentally unstable and therefore can be difficult to control, presenting some risk that the user may fall. Because the balls tend to roll around on the floor, they can be difficult to keep clean. While seating balls can be found in business settings, they lack professional and functional appeal.

BRIEF SUMMARY OF THE INVENTION

The present invention provides a seat that promotes small movements by the seated user through a seat pan that may flex in multiple directions from a horizontal position as supported by an elastomeric joint. The elastomeric joint provides controlled stability (unlike a seating ball) to better balance the user while still promoting small movements. This type of movement promotes circulation, facilitates nourishment and preservation of the intervertebral discs of the lower spine, improves core muscle stability, and relieves the effects of static strain on the body (especially the back). Human intervertebral discs have no direct blood supply. The continuous osmotic fluid exchange that maintains the nutrition, health and integrity of the discs to act as efficient load transfer devices and shock absorbers depends on movement of this type.

Specifically then, the present invention provides an ergonomic seat having a seat pan for receiving and supporting a seated user, and a base sitting against the floor and providing an elevated mounting point. An elastomeric joint connects the elevated mounting point to the seat pan allowing a flexing of a plane of the seat pan from a neutral position, substantially parallel to the floor, to a flex angle where the seat pan is tipped from the neutral position. The elastomeric joint provides increasing resistance to increased flex angle as the flex angle increases and an adjustment mechanism provides for control of a functional relationship between flex angle and resistance to increased flex angle.

It is thus an object of the invention to provide a seat with improved mobility in the seat pan while preserving stability to the seated user.

The elastomeric joint may include at least one elastomeric washer sandwiched between rigid plates, a lower of which is attached to the base and an upper of which is attached to the seat pan.

It is thus another object of the invention to provide an extremely simple and reliable mechanism that does not require high force metal springs or metal-to-metal contact that can result in undesirable noise under constant joint movement.

The elastomeric joint may include one or more spacers between the elastomeric washer and at least one of the rigid plates whereby flexing of the plane of the seat pan from the neutral position changes a pressure contact area between the elastomeric washer and at least one of the rigid plates as a function of flex angle.

It is thus another object of the invention to permit precise tailoring of the functional relationship between flex angle and return force by changing not only the amount of compression but the area of interface with the elastomeric washer.

The spacers may also be elastomeric washers.

It is thus an object of the invention to permit further tailoring of the return force through the introduction of different elastomeric materials.

The elastomeric joint may include an adjustable clamp for controlling a pre-compression (or pre-loading) of the elastomeric washer in the neutral position.

It is thus an object of the invention to allow adjustment of the return force, for example, for users of different weights.

The flex angle may extend over 360° around a normal to the neutral plane of the seat pan.

It is thus an object of the invention to provide greater freedom of movement to the seated user than is obtained in a standard rocking-type chair.

The functional relationship between flex angle and resistance to flex angle may be increasingly increasing as one moves from the neutral position.

It is thus an object of the invention to provide a functional relationship between flex angle and return force that can counteract the torque exerted on the seat pan by the seated user whose effects also increase with angle.

The functional relationship between flex angle and resistance to flex angle may substantially offset increasing torque on the seat pan as a function of flex angle caused by the weight of an average seated user.

It is thus an object of the invention to provide a high mobility seat pan that is fundamentally stable.

The base may include a standard telescopic column providing swivel rotation and adjustable height of the seat pan. The base may also include standard caster wheels or glides.

It is thus an object of the invention to provide a mechanism that can be incorporated into standard adjustable-height seating such as office chairs and stools.

The elastomeric joint may include at least one washer providing a sliding interface between the elastomeric washer and one of the rigid plates to allow relative rotation between the elastomeric washer and the rigid plate.

It is thus an object of the invention to provide a rotating interface between the washer and the plates for simple implementation of a clamp by a central carriage bolt or the like.

The seat may further include a sensor array detecting flex angle and communicating it as electrical signals.

It is thus an object of the invention to provide a seat that may monitor activity by the user.

The seat may further include an electronic computer operating a stored program to receive the electrical signals indicating flex angle and to provide an interactive visual display to a seated user encouraging the seated user to maneuver the seat pan to different flex angles.

It is thus an object of the invention to provide a seat not only with improved mode ability but that may be used to implement an active therapeutic regimen with the user.

These particular features and advantages may apply to only some embodiments falling within the claims and thus do not define the scope of the invention.

DETAILED DESCRIPTION OF THE PREFERRED EMBODIMENT

Figure 1:
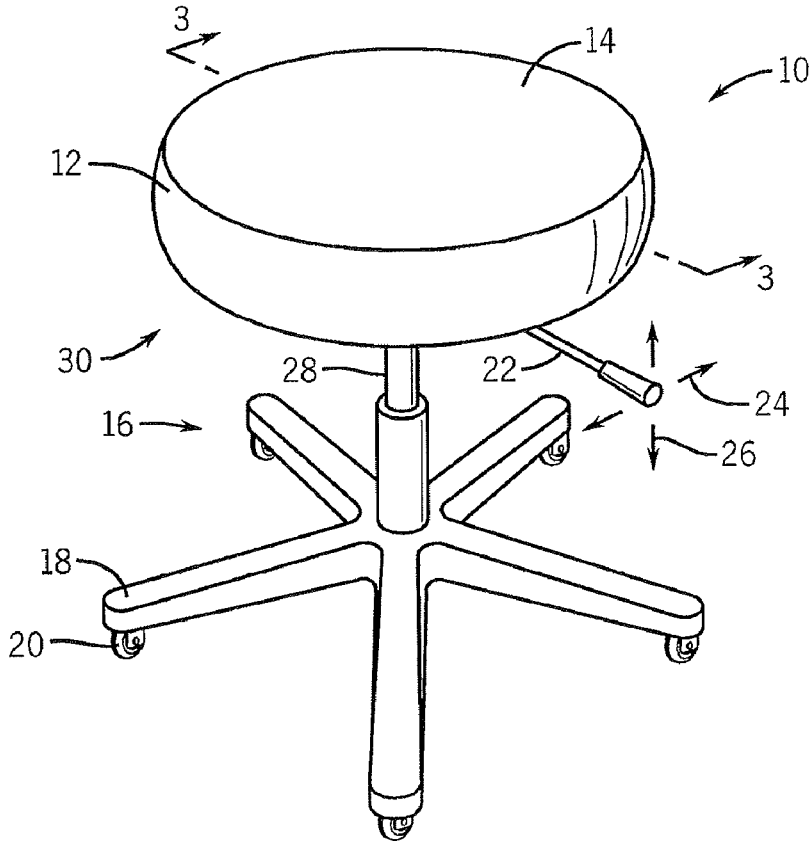
FIG. 1 is a perspective view of a seat having a seat pan and a base as may be used with the present invention and further showing a control handle having two degrees of movement for adjusting seat height and for adjusting compression force characteristics of an elastomeric joint.

Referring now to FIG. 1, a seat 10 suitable for use with the present invention may provide a seat pan 12 having an upper surface 14 for supporting a seated user. The seat pan 12 may be supported on a base 16, for example, a standard office chair pedestal base having multiple legs 18 and caster wheels 20.

A control lever 22 may extend horizontally outward from beneath the seat pan 12 to provide for control of the seat 10 through a horizontal actuation 24 or a vertical actuation 26. The vertical actuation 26 controls a standard air spring incorporated into the base 16 according to methods known in the art. The base 16 provides an elevated mounting point at the top of the stanchion 28 (not visible in FIG. 1) which may connect the base 16 to the seat pan 12 through an elastomeric joint 30 that will now be described.

Figure 3:
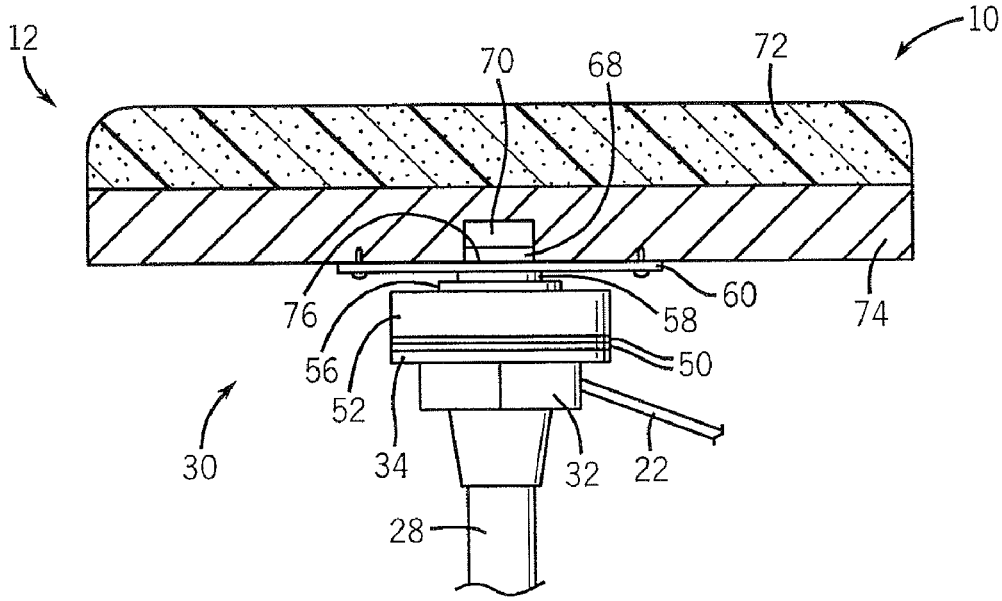
FIG. 3 is a cross-section taken along lines 3-3 of FIG. 1 showing the joint of FIG. 2 assembled and attached to the seat of FIG. 1.
Figure 2:
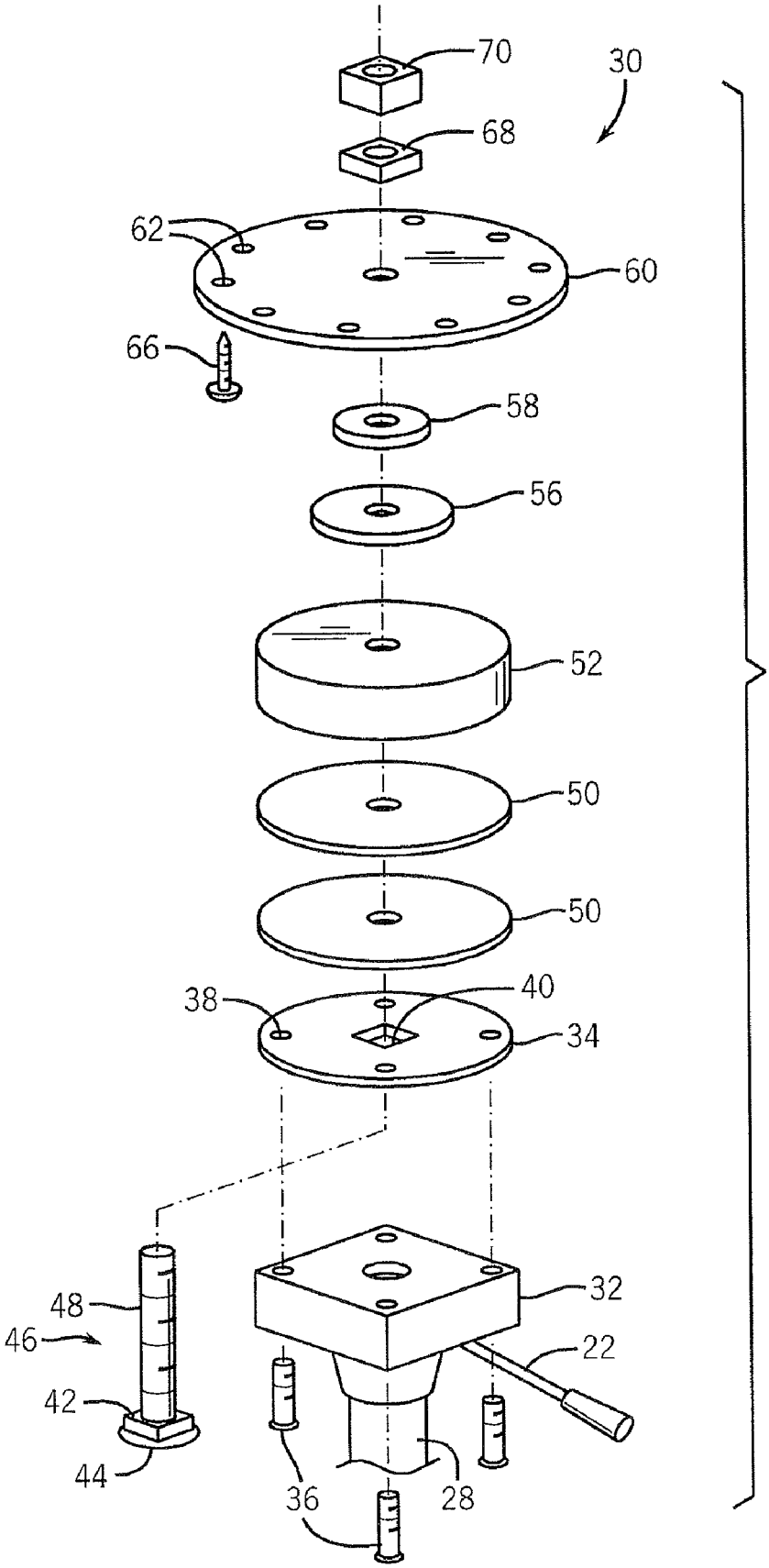
FIG. 2 is an exploded view of the elastomeric joint of FIG. 1 connecting the seat and base of the stool, the elastomeric joint providing one or more elastomeric washers as may be held between rigid plates.

Referring now to FIGS. 2 and 3, the top end of the stanchion 28 may be received by a support block 32 providing the elevated mounting point and receiving the control lever 22. The support block 32 includes a mechanism for providing control of an air spring and changing the height of stanchion 28 according to standard techniques. The air spring and stanchion 28 permit swiveling rotation around a vertical axis.

The support block 32 provides a substantially horizontal upper face that may support a first rigid plate 34 which may, for example, be constructed of a disk of metal such as aluminum or steel. The first rigid plate 34 is held to the upper face of the support block 32 by bolts 36 passing through the support block 32 to be received by corresponding threaded holes 38 in the rigid plate 34. Bolts 36 are of a length that does not interfere with components on top of plate 34.

The rigid plate 34 includes a center hole 40 having a square perimeter that may engage with a corresponding square shank 42 extending from the head 44 of a carriage bolt 46. The engagement of the square shank 42 and the rigid plate 34 is such as to prevent relative rotation between the two. The carriage bolt 46 may pass upward through the hole 40 so that the threaded portion 48 of the carriage bolt 46 extends upward from the support block 32 to rotate about a vertical axis therewith. Swiveling stanchion 28 allows rotation of support block 32 without rotating the whole base 16.

On top of rigid plate 34 may be placed two slide washers 50 being substantially of equal diameter with rigid plate 34 and having central holes for receiving the threaded portion 48 of the carriage bolt 46. These slide washers 50 may be constructed of a self-lubricating or low friction material such as ultrahigh molecular weight plastic, polyethylene, Teflon or the like.

On top of slide washers 50 is fit an elastomeric washer 52 being of equal diameter to slide washers 50 and rigid plate 34 but being substantially thicker than slide washers 50 and being in the preferred embodiment between ½" and 1½ inches. A material having a durometer-Shore A of 63 and a tear strength of 135 pounds per inch may be used. The elastomeric washer 52 also has a center aperture held and stabilized by the threaded portion 48 of the carriage bolt 46.

A lower washer 56 and upper washer 58 may rest on top of the elastomeric washer 52 with the lower washer 56 having a diameter equal to or smaller than elastomeric washer 52 and upper washer 58 having a diameter equal to or smaller than lower washer 56. These washers may preferably also be elastomeric material and may be of the same or different material as washer 52. Within the scope of this invention, it would be apparent to someone skilled in the art that different quantities, sizes, shapes and materials of washers could be used to achieve desired effects.

On top of upper washer 58 is placed a second rigid plate 60 serving with rigid plate 34 to sandwich elastomeric washer 52 (and washers 50, 56 and 58) therebetween. Rigid plate 60 has peripheral holes 62 that may receive screws 66 passing upward through the rigid plate 60 to affix it to the underside of the seat pan 12.

A square spacer 68 may be positioned above a central hole in the rigid plate 60 receiving passage of the threaded portion 48 of the carriage bolt 46 therethrough. Square spacer 68 may be made of elastomeric material. On top of the square spacer 68 may be positioned a square nut 70 of similar dimensions engaging the threaded portion 48 of the carriage bolt 46. Square spacer 68 prevents rigid nut 70 from incurring direct force against rigid plate 60. As will be understood, tightening of the nut 70 will compress the elastomeric washers 52, 56 and 58 between rigid plates 34 and 60 together and hold the seat pan 12 to the stanchion 28. The seat top (including seat pan 12, square nut 70, square spacer 68 and rigid plate 60) can be quickly attached or removed as one unit. This permits ready interchange of the seat top and easy access to reconfigure elastomeric washers 52, 56 and 58. Therefore, the seat top and the elastomeric joint can be readily optimized for many different applications.

Referring now to FIG. 3, the seat pan 12 may include an upper foam layer 72 supported by a rigid layer 74, the latter for example being plywood or composite wood or the like. A square bore 76 cut in the underside of the rigid layer 74 receives the square spacer 68 and square nut 70 and holds them to allow axial motion but to prevent lateral motion. When adjusting 24 pre-compression of the elastomeric joint 30 with control lever 22, the square bore 76 prevents square spacer 68 and square nut 70 from rotating when receiving the threaded portion 48 of carriage bolt 46. A thin layer of flexible retaining material (not shown) may be fastened to the top surface of rigid layer 74 directly above square bore 76 to prevent a non-engaged square nut 70 from migrating upward into the foam layer 72.

The aperture of the rigid plate 60 may be sized to be larger than the diameter of the threaded portion 48 of the carriage bolt 46 so that the positioning of the rigid plate 60 to the rigid layer 74 prevents contact between rigid plate 60 and the threaded portion 48 of the carriage bolt 46, the latter as held by the square spacer 68 away from contact with the rigid plate 60. This spacing is such as to prevent rubbing of the metallic rigid plate 60 against the threaded portion 48 of carriage bolt 46 during angular motion of the seat pan 12.

Figure 4:
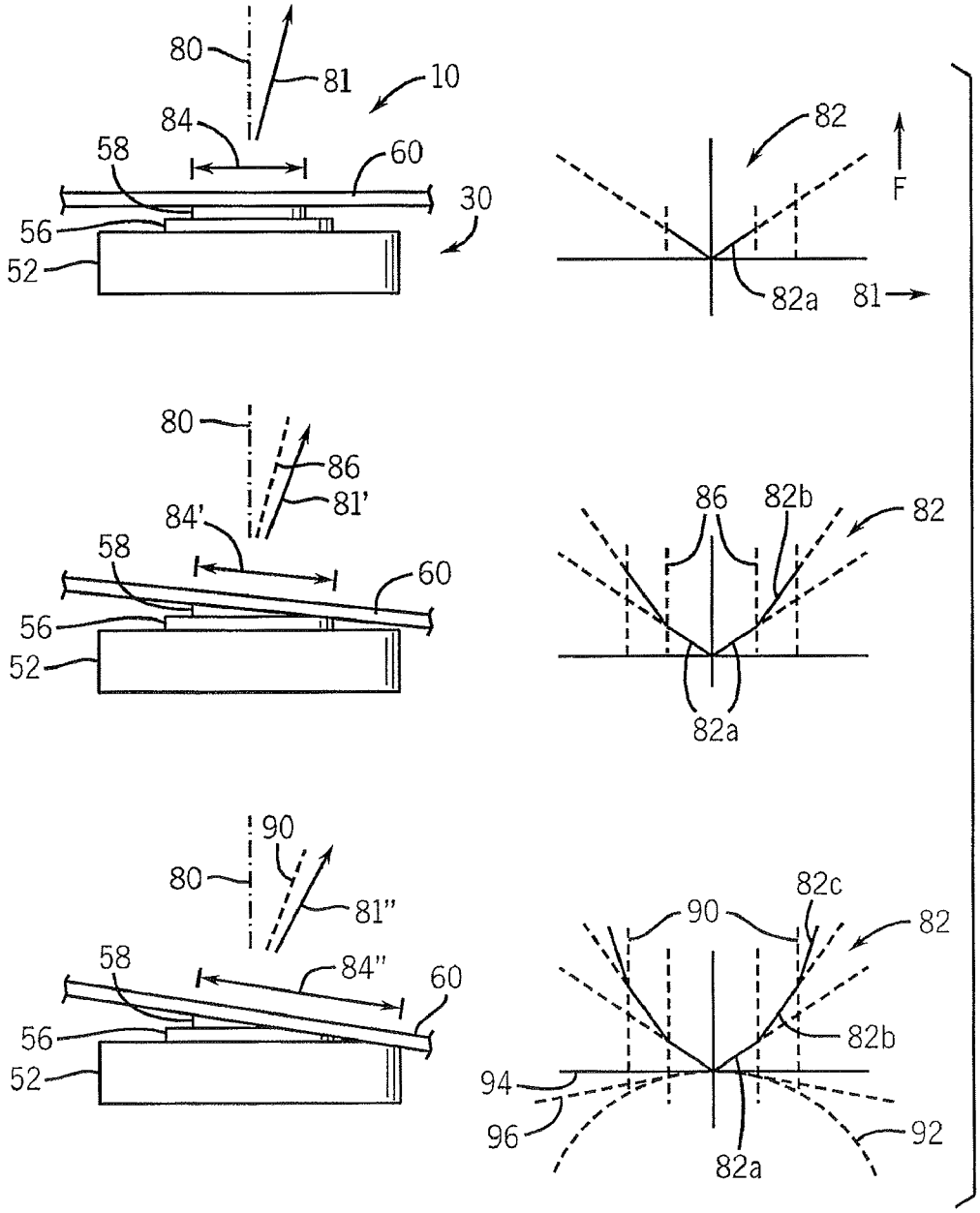
FIG. 4 is a simplified representation of the joint of FIG. 3 with three different amounts of flex angle showing a force curve that is increasingly increasing as one moves from a neutral position.

Referring now to FIG. 4, when the seat 10 is unoccupied the rigid plate 60 (and thus the seat pan 12) is generally in a horizontal position having a vertical surface normal. This normal position will be termed the neutral position 80.

Flexure to a first flex angle 81 deviating from the neutral position 80 will experience a generally linear return force 82*a* as a function of flex angle 81 caused by the effective linear spring constant of compression of the washers 58, 56 and 52 against the rigid plate 60 over a first contact area 84 that is approximately constant because of a spacing of the plate 60 from the washers 56 and 52 by washer 58.

As the flex angle increases to flex angle 81' past a first angle limit 86, in any of 360° about neutral position 80, the rigid plate 60 contacts the second washer 56 increasing the effective surface of contact area 84' between the rigid plate 60 and the washers 58, 56 and 52 causing an upward angling in the return force curve 82 as indicated by return force segment 82*b*.

When the flex angle 81" exceeds a second threshold 90, the rigid plate 60 contacts all three of the washers 58, 56 and 52, increasing the contact area 84" and providing yet a steeper return force segment 82*c* caused by that increased contact area.

Generally the seated user will exert a user torque 92 on the elastomeric joint 30 that will also increase with flex angle 81. The direction of this user torque 92 is opposite that provided by the joint 30, and thus the combined effect of the return force curve 82 and the torque exerted by the user by the user's off-center weight can be balanced to provide a stable flexure 94 or a slightly unstable flexure 96, the latter promoting a small amount of motion inducing instability.

Selection of the dimensions and materials of washers 58, 56, and 52 can precisely control the shape of this flexure 94 or 96. It will be understood, that a similar effect to that provided by washers 56 and 58 may be had by shaping the upper surface of washer 52, for example, to provide a convex surface. Generally the composition of the 58, 56, and 52 need not be homogenous and/or their shapes may be varied from disks to provide for anisotropic restoring forces providing different degrees of support for different directions of tilting of the seat pan 12.

Figure 5:
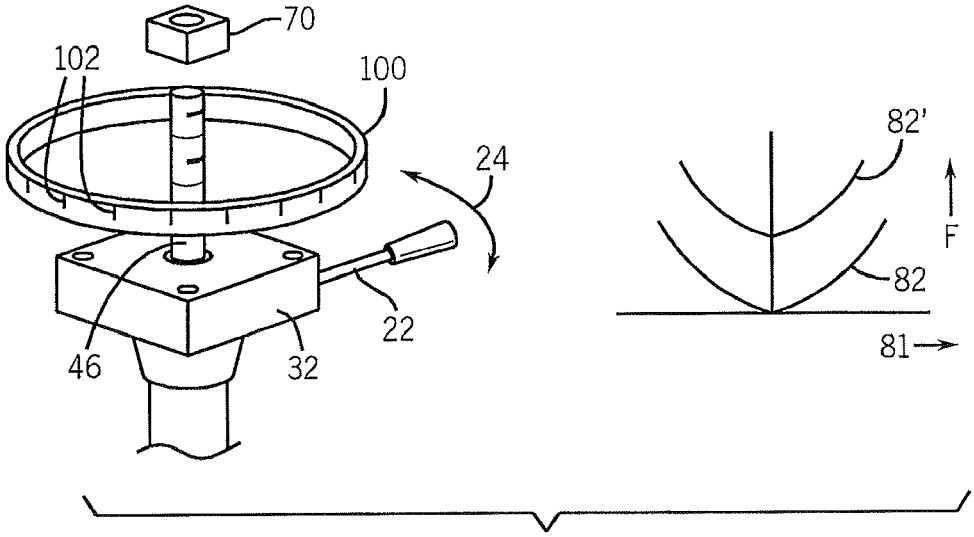
FIG. 5 is a simplified perspective view of a clamp mechanism for pre-compressing the elastomeric joint of FIG. 3 in which the handle is used to measurably increase or decrease the pre-loading on the washer(s) changing a force offset of the force curve.

Referring now to FIG. 5, rotation of the support block 32 with respect to the nut 70 held in the seat pan (not shown) by movement of the control lever 22 in a horizontal actuation 24 can cause rotation of the carriage bolt 46 with respect to the nut 70. This in turn clamps elastomeric washers 58, 56 and 52 between rigid plate 60 and rigid plate 34 (shown in FIG. 2) increasing the pre-compression and shifting the return force curve 82 upward to return force curve 82'. This adjustment mechanism may be guided by a graduated shroud 100 surrounding the joint 30 having marked intervals 102 that may be aligned with the control lever 22 to provide repeatable and quantifiable adjustment. Similarly, a mechanical or electronic encoder may quantify actuation 24 of control lever 22. This adjustment, by shifting the return force curve 82 upward to return force curve 82', can compensate for steeper force curves of user torque 92 caused by users of higher weight. Alternatively, the lever 22 may be provided with a torque control or indicator (in the manner of a conventional torque wrench) to control the degree of compression of elastomeric joint 30 while also providing a quantitative adjustment mechanism.

Figure 6:
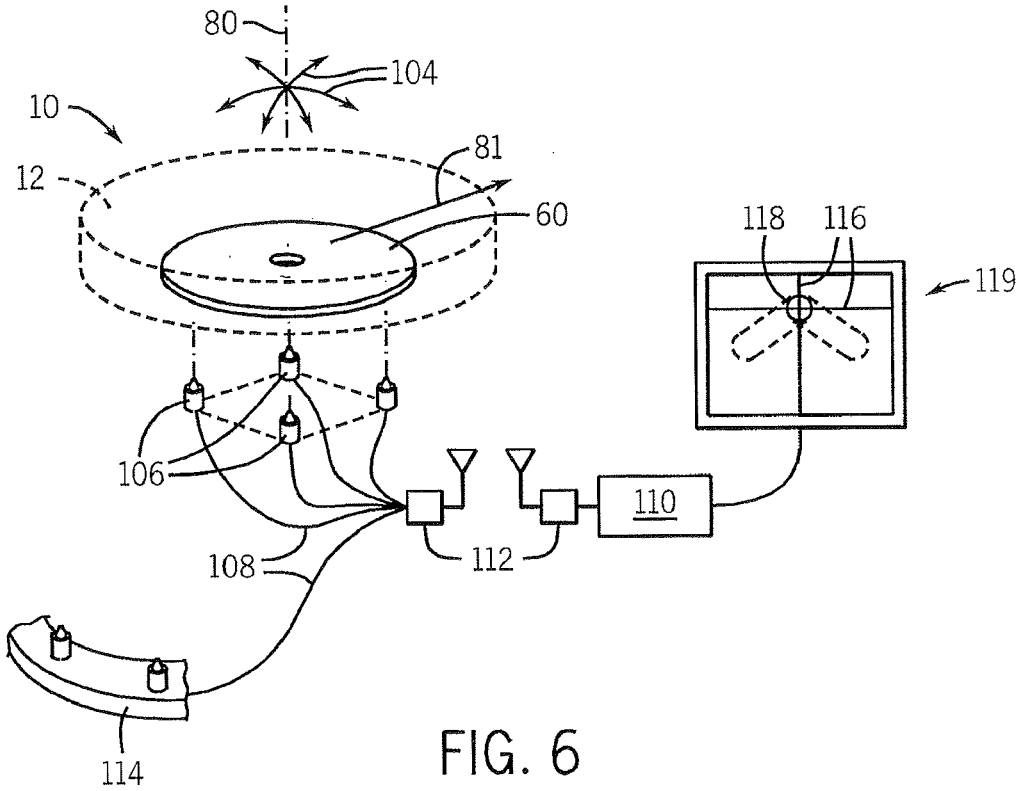
FIG. 6 is a simplified schematic of a sensor array positioned on the seat of FIG. 1 to communicate movements of the user to a computer, the latter which may be programmed to provide a diagnostic or therapeutic routine.

Referring now to FIG. 6, the present invention provides multiple degrees of freedom 104 in flex angles 81 about the neutral position 80 allowing improved accommodation of the user's natural desire to move while seated. The particular flex angles 81 both in amount of angulation and direction of angulation may be detected by sensors 106, for example, mounted beneath the seat pan 12 and, in the simplest case, being switches that are compressed with flex angles 81 in different directions to a threshold amount. Alternatively the sensors may be accelerometers or solid-state gyroscopes attached to the seat pan 12. The sensors 106 may provide electrical signals to harness 108 communicated to a computer 110 either by direct-wired connection or wireless link 112 as depicted. A foot pedal unit 114 may also be provided and connected to the harness 108 so that together the sensors 106 and foot pedal unit 114 emulate the standard joystick or two-button mouse control familiar to computer users. For example, this may provide a hands-free alternative for handicap accessibility to computers. For another example, in an office environment, the seat pan may provide for general improved seating quality while also being enlisted periodically to promote exercise by the user.

The seat 10 may thus be enlisted in controlling a cursor 118 on a computer screen 119 with the seat standing in for a normal cursor control device. Alternatively or in addition the computer 110 may be programmed to provide an exercise routine, for example, generating a moving object that must be tracked with crosshairs 116 controlled by the user by tilting the seat 10 and activating the sensors 106.

For example, as part of a therapeutic computer program, performance results may be stored in data files and patterns of weakness may be used diagnostically to analyze balance and core muscle stability disorders. Therapeutic "games" may then target prescribed exercise movement patterns to address specific problems. Scores may then be charted from stored data files to observe and quantify patient progress over time.

It will be understood that many new and existing computer games may be used with this invention for entertainment or therapeutic purposes.

Figure 7A:
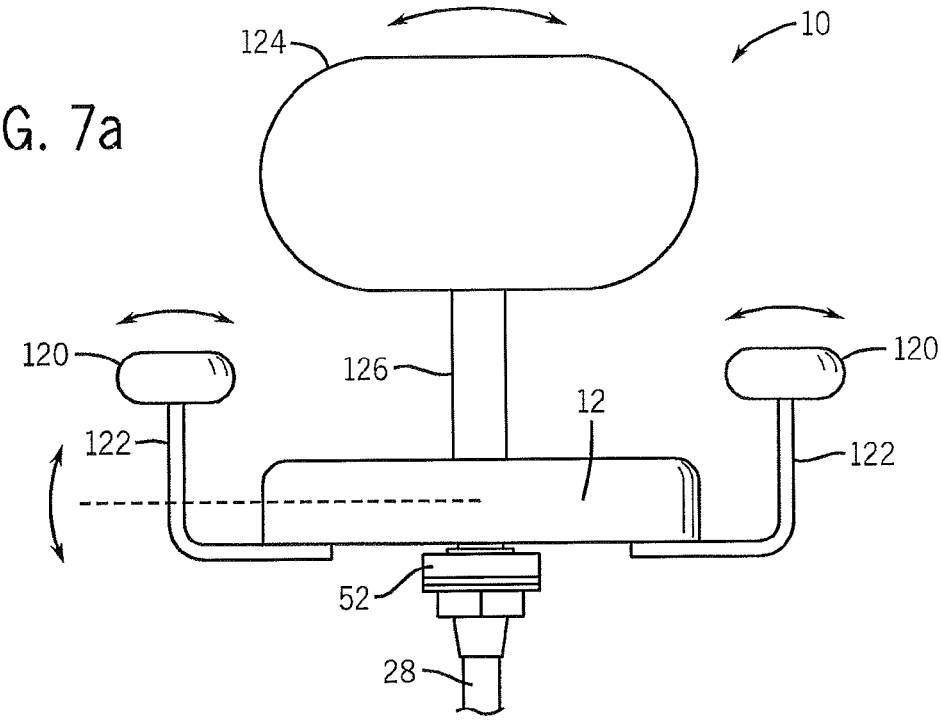
FIGS. 7*a* and 7*b* are front elevational views of embodiments of the seat of FIG. 1 providing armrests and a backrest that move with the seat pan (in FIG. 7*a*) or to remain stationary during movement of the seat pan (in FIG. 7*b*).

Referring now to FIG. 7*a*, the seat 10 may be provided with armrests 120 having supports 122 attached between the armrests 120 and the lower surface of the seat pan 12. Likewise the seat 10 may be provided with a seatback 124 or lumbar support having a support 126 attached between the seatback 124 and the lower surface of the seat pan 12. In this embodiment, the seatback 124 and armrests 120 will move in angulation in multiple directions with corresponding movement of the seat pan 12. In this way, the seatback 124 and armrests 120 permit natural movement while providing continuous support.

Figure 7B:
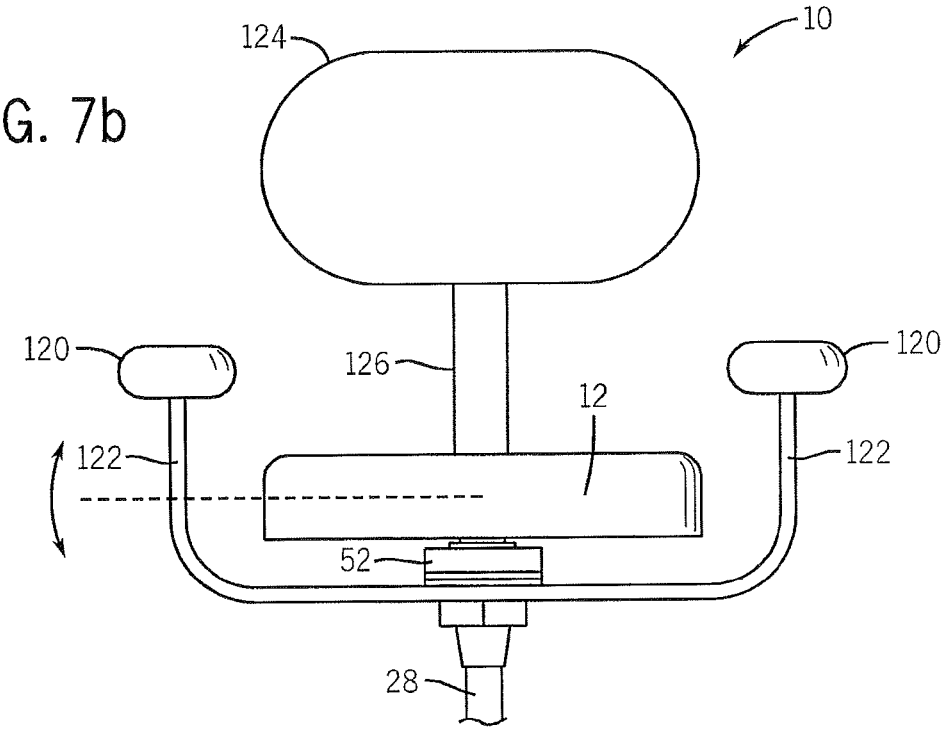

Referring to FIG. 7*b*, in an alternative embodiment, a lower end of the support 126 of the seatback 124 may be attached to the stanchion 28 as may be the lower end of the supports 122 of the armrests 120. In this configuration, the seatback 124 and armrests 120 will remain stationary during movement of the seat pan 12.

In both the embodiments of FIGS. 7*a* and 7*b*, the seatback 124 and armrests 120 are free to rotate about a vertical axis with the seat pan 12 in the manner of a standard task chair and may elevate with the seat pan 12 for height adjustment. The height of the armrests 120 and seatback 124 may be adjusted by conventional mechanisms (not shown).

It is specifically intended that the present invention not be limited to the embodiments and illustrations contained herein and the claims should be understood to include modified forms of those embodiments including portions of the embodiments and combinations of elements of different embodiments as come within the scope of the following claims.

We claim:

1. An ergonomic seat comprising:

a seat pan for receiving and supporting a seated user;

a base sitting against the floor and providing an elevated mounting point wherein the base includes a telescopic column having an upper portion and lower portion controllably extending with respect to each other along an axis to provide an adjustable height of the seat pan and rotating with respect to each other about the axis;

an elastomeric joint connecting the elevated mounting point to the seat pan allowing a flexing of a plane of the seat pan from a neutral position substantially parallel to a floor to a flex angle where the seat pan is tipped from the neutral position, whereby the elastomeric joint provides increasing resistance to increased flex angle as the flex angle increases by at least partial compression of an elastomeric element wherein a direction of the flex angle extends over a 360° range around a normal to the plane of the seat pan in a neutral position and the relationship of resistance to flex angle is substantially uniform over the range; and an adjustment mechanism for controlling a functional relationship between flex angle and resistance to increased flex angle the adjustment mechanism further including:

a clamp mechanism adjustably applying a preloading to the elastomeric element, the clamp mechanism providing a coupling having one portion attached to rotate with the seat pan and a second portion attached to rotate with the upper portion of the telescopic column; the two portions threadably engaged;

a control lever having a proximal end communicating with the clamp mechanism and a distal end graspable by a user seated on the seat pan, movement of the control lever rotating the upper portion of the telescopic column to adjust the preloading of the elastomeric element and communicating with the telescopic column to control extension of the column.

2. The ergonomic seat of claim 1 wherein the elastomeric joint comprises at least one elastomeric washer sandwiched between rigid plates, a lower of which is attached to the base and an upper of which is attached to the seat pan.

3. The ergonomic seat of claim 2 including at least one second elastomeric washer of smaller diameter than the elastomeric washer and positioned between the elastomeric washer and at least one of the rigid plates whereby flexing of the plane of the seat pan from the neutral position changes a pressure contact area between the elastomeric washer, the at least one second elastomeric washer, and at least one of the rigid plates as a function of flex angle.

4. The ergonomic seat of claim 2 further including at least one washer providing a sliding interface between the elastomeric washer and one of the rigid plates to allow relative rotation between the elastomeric washer and the rigid plate.

5. The ergonomic seat of claim 1 wherein the functional relationship between flex angle and resistance to flex angle is increasingly increasing by increasing an area of the surface in contact with the material of the elastomeric joint as one moves the seat pan from the neutral position.

6. The ergonomic seat of claim 5 wherein the functional relationship between flex angle and resistance to flex angle substantially offsets increasing torque on the seat pan as a function of flex angle caused by the weight of an average seated user.

7. The ergonomic seat of claim 1 further including a sensor array detecting flex angle and communicating it as electrical signals.

8. The ergonomic seat of claim 7 further including an electronic computer operating a stored program to receive the electrical signals indicating flex angle and to provide a visual display to a seated user encouraging the seated user to maneuver the seat pan to different flex angles.

9. The ergonomic seat of claim 1 further including at least one of an armrest and seat back attached to the seat pan to move with the seat pan when the seat pan is tipped from the neutral position.

10. The ergonomic seat of claim 1 further including at least one of an armrest and seat back attached to the base to remain stationary when the seat pan is tipped from the neutral position.

* * * * *